US005332022A

United States Patent [19]

Colvin

[11] Patent Number: 5,332,022

[45] Date of Patent: * Jul. 26, 1994

[54] COMPOSITE CASTING METHOD

[75] Inventor: Gregory N. Colvin, Muskegon, Mich.

[73] Assignee: Howmet Corporation, Greenwich, Conn.

[ * ] Notice: The portion of the term of this patent subsequent to Sep. 7, 2010 has been disclaimed.

[21] Appl. No.: 942,020

[22] Filed: Sep. 8, 1992

[51] Int. Cl.[5] ..... B22D 19/02

[52] U.S. Cl. ..... 164/98; 164/100; 164/112; 164/76.1

[58] Field of Search ..... 164/76.1, 91, 98, 112, 164/332, 334; 228/193, 243, 176; 29/526.2, 526.3, 527.5

[56] References Cited

U.S. PATENT DOCUMENTS

| | | | |
|---|---|---|---|
| 2,084,247 | 6/1937 | Dockray et al. . | |
| 2,161,116 | 6/1939 | White . | |
| 2,745,437 | 5/1956 | Comstock, III . | |
| 3,659,645 | 5/1972 | Rose . | |
| 3,758,347 | 9/1973 | Stalker . | |
| 3,819,145 | 6/1974 | Huber et al. . | |
| 4,186,473 | 2/1980 | Cross et al. . | |
| 4,250,610 | 2/1981 | Wilbers et al. . | |
| 4,270,256 | 6/1981 | Ewing | 228/193 |
| 4,494,287 | 1/1985 | Cruzen et al. | 164/76.1 |
| 4,538,331 | 9/1985 | Egan et al. | 164/76.1 |
| 4,572,270 | 2/1986 | Funatani et al. . | |
| 4,581,300 | 4/1986 | Hoppin, III et al. | 228/193 |
| 4,752,816 | 5/1989 | Ewing et al. | 228/186 |
| 4,889,177 | 12/1989 | Charbonnier et al. . | |
| 4,987,944 | 1/1991 | Parks | 164/112 |

FOREIGN PATENT DOCUMENTS

| | | | |
|---|---|---|---|
| 58-61959 | 4/1983 | Japan . | |
| 58-209464 | 12/1983 | Japan . | |
| 0076655 | 5/1984 | Japan | 164/112 |
| 59-82157 | 5/1984 | Japan . | |
| 60-158968 | 8/1985 | Japan . | |
| 0295603 | 12/1971 | U.S.S.R. | 164/112 |
| 16286 | of 1913 | United Kingdom . | |
| 2098112 | 11/1982 | United Kingdom . | |

*Primary Examiner*—P. Austin Bradley
*Assistant Examiner*—Erik R. Puknys
*Attorney, Agent, or Firm*—Flynn, Thiel, Boutell & Tanis

[57] ABSTRACT

A method of making a composite casting wherein a casting mold is provided having a melt-receiving mold cavity and a preformed metallic or intermetallic insert located in a predetermined position in the mold cavity. A melt is introduced into the mold cavity about the insert and is solidified to provide a composite casting having one or more interfaces between the insert, or an insert positioning member, and cast/solidified metal about the insert. The interface is exposed on or communicates with an exterior surface of the composite casting. After separation from the mold, the composite casting is subjected to a sealing operation to gas-tight seal the interface(s) at the exterior casting surface. For example, the interface can be sealed by providing fused material at the interface. After the interface(s) is (are) sealed, the composite casting is subjected to elevated temperature and isostatic gas pressure conditions effective to produce a sound, void-free, contamination-free metallurgical bond between the insert and the cast melt thereabout. The previously sealed interface(s) prevent the pressurizing gas from entering and migrating between the insert and the cast melt so as to enable formation of the sound, void-free, contamination-free bond.

12 Claims, 2 Drawing Sheets

COMPOSITE CASTING METHOD

FIELD OF THE INVENTION

The present invention relates to a method of making a composite casting having a preformed metallic or intermetallic insert, such as, for example, a reinforcement insert comprising a metal matrix composite, bonded in a preselected position therein.

BACKGROUND OF THE INVENTION

Components for aerospace, automotive, and like service applications have been subjected to the ever increasing demand for improvement in one or more mechanical properties, such as tensile strength, ductility, fatigue life, resistance to impact damage, etc. while at the same time maintaining or reducing the weight of the component. To this end, the Charbonnier et al. U.S. Pat. No. 4,889,177 describes a method of making a composite casting wherein a molten lightweight alloy, such as aluminum or magnesium, is countergravity cast into a gas permeable sand mold having a fibrous insert of high strength ceramic fibers positioned therein by metallic inserts so as to be incorporated into the casting upon solidification of the molten alloy.

The Funatani et al. U.S. Pat. No. 4,572,270 describes a method of making a composite casting to this same end wherein a mass of high strength reinforcing material, such as ceramic fibers, whiskers, or powder, is incorporated into a lightweight metal matrix (e.g., aluminum or magnesium) that is die cast around the reinforcing mass in a pressure chamber.

A technique commonly referred to as bicasting has been employed in attempts to improve one or more mechanical properties of superalloy castings for use as aerospace components. Bicasting involves pouring molten metal into a mold cavity in which a preformed insert is positioned in a manner to augment one or more mechanical properties in a particular direction(s). The molten metal surrounds the insert and, upon solidification, yields a composite casting comprising the insert embedded in and hopefully soundly bonded with the cast metal without contamination therebetween. However, as described in U.S. Pat. No. 4,008,052 attempts at practicing the bicasting process have experienced difficulty in consistently achieving a sound metallurgical bond between the insert and the metal cast therearound without bond contamination. Moreover, difficulty has been experienced in positioning the insert in the mold cavity and thus in the final composite casting within the required location tolerances. The inability to achieve on a reliable and reproducible basis a sound, contamination-free bond between the insert and the cast metal has significantly limited use of bicast components in applications, such as aerospace components, where reliability of the component in service is paramount.

SUMMARY OF THE INVENTION

The present invention provides an improved bicasting type of process for making a composite casting wherein a sound, contamination-free metallurgical bond is reliably and reproducibly produced between a preformed insert and the cast metal therearound.

The present invention involves a method of making a composite casting wherein a casting mold is provided having a melt-receiving mold cavity and a preformed metallic or intermetallic insert located in a predetermined position in the mold cavity. A melt is introduced into the mold cavity about the insert and is solidified to provide a composite casting having one or more interfaces between the insert, or an insert positioning member, and cast/solidified metal about the insert. The interface is exposed on or communicates with an exterior surface of the composite casting so as to thereby communicate with the ambient atmosphere.

After separation from the mold, the composite casting is subjected to a sealing operation to fluid-tight seal the interface(s) at the exterior casting surface. For example, the interface(s) can be sealed by providing fused material at the interface(s) at the exterior casting surface. The fused material can be provided by welding (without filler material) proximate portions of the insert and the solidified melt under vacuum, air, or inert cover gas. Alternately, the fused material can be provided by depositing a weld filler material at the interface(s). However, the invention is not limited to sealing of the interface(s) by welding. For example, the interface(s) can also be sealed by liquid metal sintering, brazing, or other techniques where a fused material is provided, either by melting proximate portions of the insert and cast/solidified melt or by introducing a separate filler material (e.g., a weld filler material or braze material), at the interface(s).

After the interface(s) is (are) sealed, the composite casting is subjected to elevated temperature and elevated isostatic fluid (e.g. gas) pressure conditions effective to produce a sound, void-free, contamination-free metallurgical bond between the insert and the cast melt thereabout. The previously sealed interface(s) prevent the pressurizing fluid from entering and migrating between the insert and the cast/solidified melt so as to enable formation of the sound, void-free, contamination-free bond. The sealed region(s) of the composite casting typically (but not always) is (are) removed and discarded after the bonding operation.

In one embodiment of the invention, the insert is located in the mold cavity with opposite ends thereof extending outside the mold cavity through opposite mold walls or caps. In this arrangement, a peripheral interface is formed between the insert and melt cast and solidified thereabout at opposite ends of the composite casting. These interfaces are sealed in fluid-tight manner as described hereabove.

In another embodiment of the invention, the insert is located in the mold cavity by slender positioning members, such as pins and/or chaplets, between the mold inner walls and the insert. In this arrangement, an interface is formed between each pin and/or chaplet and the melt cast and solidified thereabout at an external casting surface. These interfaces are sealed in a fluid-tight manner as described hereabove.

In practicing the present invention, the insert may comprise a metallic (e.g. Ti alloys) or intermetallic (e.g. TiA1) material which may include reinforcing filaments, particulates, etc. therein. An exemplary preformed insert comprises a metal matrix composite. The metallic or intermetallic material of the insert may correspond substantially in composition to the melt introduced into the mold cavity. The objects and advantages of the present invention enumerated above will become more readily apparent from the following detailed description and drawings.

DETAILED DESCRIPTION OF THE INVENTION

Figure 1:
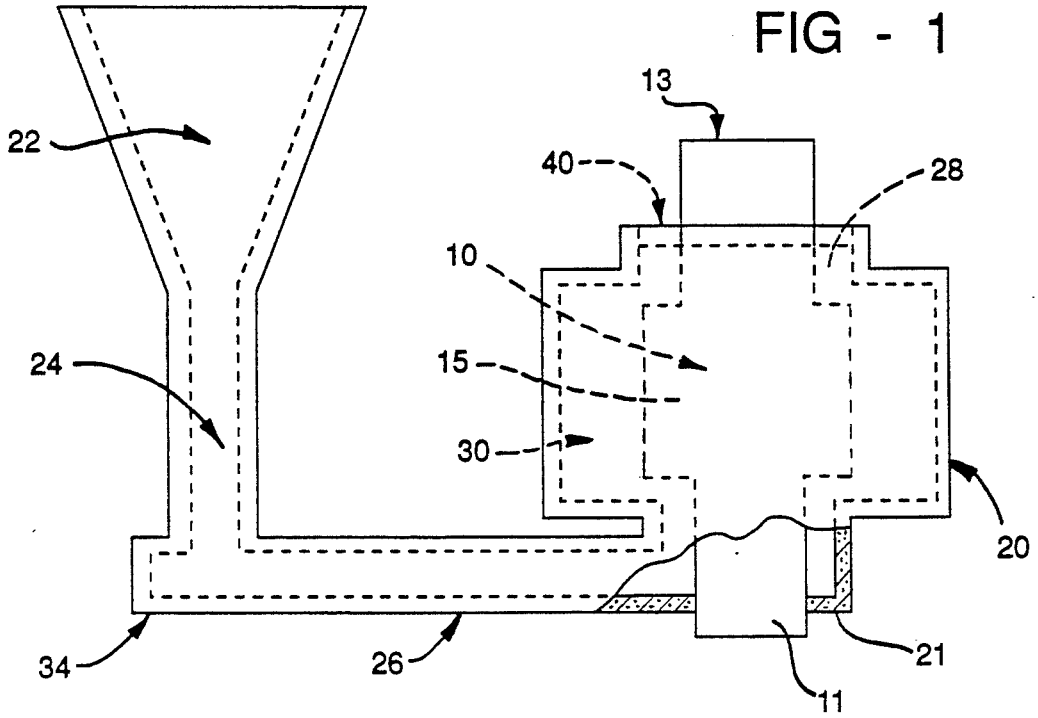
FIG. 1 is a schematic side elevational view of a ceramic shell mold with a performed insert positioned in the mold cavity thereof by opposite ends of the insert being fixed in the mold end wall and mold end closure cap.

Referring to FIG. 1, a preformed insert 10 is shown positioned in a ceramic investment casting shell mold 20. The mold 20 includes a frusto-conical funnel 22 into which a melt is poured from a suitable source, such as a ladle or crucible, a down sprue 24, and a laterally extending ingate or channel 26 that receives the melt from the down sprue 24. The ingate 26 is communicated to the mold cavity 30 so as to supply the melt thereto to fill the mold cavity 30 and the riser 28 thereabove. The shell mold 20 is fabricated in accordance with conventional shell mold practice wherein a fugitive (e.g., wax) pattern assembly in the configuration of the desired funnel 22, down sprue 24, ingate 26, riser 28 and mold cavity 30 is dipped in ceramic slurry, stuccoed or sanded with dry ceramic particulates, and then dried in repeated fashion to build up the shell mold 30 thereon. The pattern assembly is selectively removed from the shell mold 20 in conventional manner, such as by melting, dissolving, or vaporization of the pattern material. Thereafter, the shell mold 20 is fired at elevated temperature to develop proper mold strength for casting.

The preformed insert 10 is positioned in the mold cavity 30 by its lower insert end 11 being received and adhered in the lower shell mold wall 21 using a ceramic cement or adhesive and by its upper insert end 13 being received and adhered using ceramic cement or adhesive in a closure cap 40 that is fastened in the riser 28 by ceramic adhesive (not shown). The mold may be split into sections which are assembled about the insert and clamped, fastened or other-wise held together to facilitate assembly of the mold and insert. The ceramic closure cap 40 is considered part of the mold 20. It is apparent that a central region or portion 15 of the insert 10 is thereby located in the mold cavity 30 while the opposite insert ends 11, 13 extend out of the mold cavity 30 through the ingate 26 and riser 28, respectively, to the exterior of the shell mold 20.

Alternately, the preformed insert 10 may be positioned in the mold cavity 30 by forming the wax pattern about the insert except for its opposite insert ends 11,13, forming the shell mold 20 about the pattern/insert assembly by the dipping/stuccoing procedure described above so that the insert ends 11,13 are captured in the mold walls formed thereabout, and then selectively removing the pattern to leave the insert 10 located in the mold cavity 30 by its captured ends 11,13. Pattern removal and subsequent mold firing are conducted to prevent oxidation or other contamination of the insert (e.g. using a vacuum or inert gas atmosphere).

The preformed insert 10 may comprise a metallic or intermetallic material that is preformed by conventional fabrication operations, such as casting, powder metallurgy, plasma spraying, forging, etc., in the desired shape for the composite casting to be made. The preformed insert 10 may comprise a metallic or intermetallic material having a composition similar to or different from that of the melt to be cast therearound. The preformed insert 10 may include reinforcements, such as reinforcing particulates, filaments, and the like therein. For example, the preformed insert 10 may comprise a metallic (e.g. Ti Alloy such as Ti-6A1-4V) or intermetallic (e.g. TiA1) matrix reinforced with suit-able reinforcing filaments or particulates. The metal matrix composite may be sheathed with a material compatible with the melt to be cast so as to avoid unwanted reaction between the reinforcement and the cast melt.

After the preformed insert 10 is positioned in the mold cavity 30, a melt of a selected metallic or intermetallic material is poured from a ladle or crucible (not shown) under vacuum into the mold funnel 22 and travels through the down sprue 24 and ingate 26 into the mold cavity 30 and the riser 28 (or other gating configuration). The central region 15 of the preformed insert 10 is thereby surrounded by the melt. Upon solidification of the melt in the mold cavity 30, a composite casting 50 is produced and includes the preformed insert 10 embedded in the cast and solidified melt 52, see FIG. 2.

Following solidification of the melt, the mold 20 including the mold closure cap 25 is removed from the casting 50 by conventional techniques. For example, the shell mold 20 and closure cap 40 are removed by sandblasting, although other removal techniques may be employed in practicing the invention.

Figure 2:
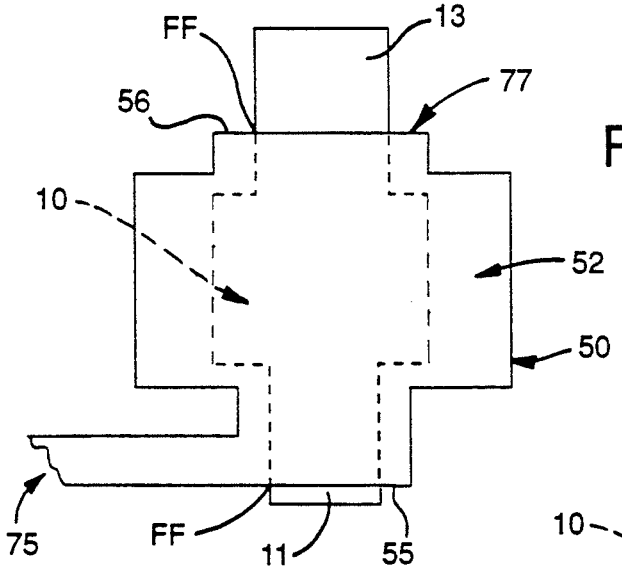
FIG. 2 is a schematic side elevational view of the composite casting formed in the mold of FIG. 1 showing the interfaces between the insert and cast/solidified melt at the external end surfaces of the casting.

The cast/solidified melt 52 in the mold ingate 26 can be removed from the composite casting 50 either prior to or after further processing. FIG. 2 shows portions of the cast/solidified melt 52 in the ingate 26 removed from the casting 50. The cast/solidified melt 52 in the riser 28 may also be removed in the same manner.

The composite casting 50 thereby produced includes interfaces FF between the cast/solidified melt 52 and the insert 10 at opposite external end surfaces 55,56 of the composite casting. The interfaces FF thus communicate with the exterior surface of the casting 52 as a result of the insert ends 11,13 extending outside of the shell mold 20 as shown in FIG. 1. The inter-faces FF are thereby exposed to the ambient atmosphere at the exterior casting end surfaces 55,56.

These exposed interfaces FF prevent subsequent hot isostatic pressing of the composite casting 50 under elevated temperature/elevated gas pressure/time conditions. Such hot isostatic pressing is effective initially to close any voids which may exist between the preformed insert 10 and the cast/solidified melt 52 therearound and then to effect such diffusion bonding as to insure that a complete, sound metallurgical bond is obtained between the insert and the surrounding cast-/solidified melt 52. In particular, the exposed interfaces FF provide a path between the insert 10 and the cast-/solidified melt 52 for the pressurizing gas (e.g., argon) to migrate and penetrate and thereby prevent metallurgical bonding between the insert and the cast/solidified melt.

Figure 3:
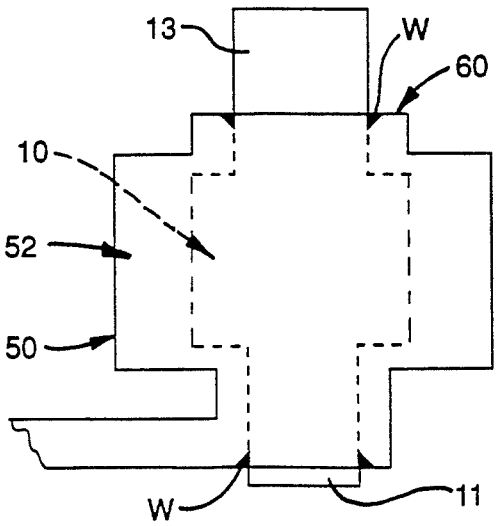
FIG. 3 is a schematic side elevational view of the composite casting of FIG. 2 after the interfaces shown between the insert and the cast/solidified melt are sealed by filler-less welding.
Figure 4:
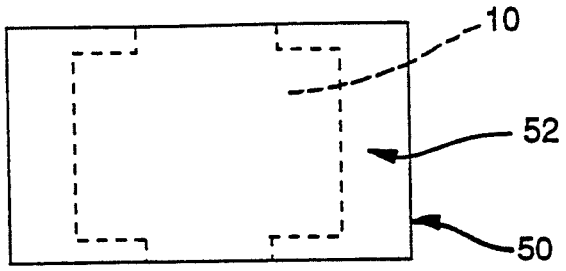
FIG. 4 is similar to FIG. 3 after regions of the composite casting including the sealed interfaces are removed and discarded.

In accordance with the present invention, the composite casting 50 is subjected to a sealing operation to fluid (gas)-tight seal the interfaces FF communicating to the exterior casting end surfaces 55,56. For example, the interfaces FF can be sealed by providing fused material at the interfaces FF. The fused material can be provided by welding (without filler material) proximate portions of the insert 10 and the solidified melt 52 preferably under vacuum (or under inert cover gas depending upon the insert and melt compositions involved). For example, the proximate portions of the insert 10 and the cast/solidified melt 52 can be electron beam welded in vacuum of $1\times10^{-3}$ torr (1 micron) to this end to form a gas-tight weld W, see FIG. 3, at the interfaces FF. Alternately, the fused material can be provided at the interfaces FF by depositing an appropriate fused weld filler material at the interfaces FF.

The invention is not limited to sealing of the interfaces FF by welding, however. For example, the interfaces FF can also be sealed by liquid metal sintering, brazing, or other technique, preferably in vacuum to avoid insert contamination, where a fused material is provided at the interfaces FF, either by melting portions of the insert and proximate cast/solidified melt themselves or by introducing a separate fused filler material (e.g., a weld filler material or braze material).

After the interfaces FF are gas-tight sealed, the composite casting 50 is subjected to elevated temperature and elevated isostatic gas pressure for a time effective to close voids and form a sound, void-free, contamination-free, metallurgical bond between the insert 10 and the cast/solidified melt 52. The particular elevated temperature/elevated gas pressure/time conditions used will be tailored to the particular melt composition employed, the insert material employed as well as the size (e.g., cross-section) of the composite casting 50.

The sealed gas-tight interfaces FF are effective to prevent penetration and migration of the isostatic pressing gas, such as argon, along the interfaces FF during the hot isostatic pressing operation. In effect, the insert 10 is sealed inside the cast/solidified melt 52 and does not communicate with the ambient high gas pressure atmosphere present during the pressing operation. As a result, a sound, void-free, contamination-free metallurgical bond is formed between the insert 10 and the cast-/solidified melt 52 by the hot isostatic pressing operation.

After the hot isostatic pressing operation, regions of the composite casting 50 including the sealed inter-faces FF may be removed and discarded. For example, the ingate region 75 including the lower sealed interface FF and the riser region 77 including the upper sealed interface FF can be trimmed from the composite casting 50. Typically, the location of the interfaces FF is chosen so to reside on regions of the casting 50 that can be removed in a trimming or similar removal operation, although the invention is not limited in this regard.

EXAMPLE

A ceramic shell mold (e.g., zirconia face-coated zircon shell) similar to FIG. 1 was made in accordance with conventional shell mold practice and included a Ti-6A1-4V preformed insert having a rectangular configuration with opposite ends extending outside the mold. The dimensions of the insert were 0.100 inch $\times$0.5 inch $\times$3.0 inch. The shell mold was formed by repeatedly dipping/stuccoing a wax pattern formed about the insert except for the opposite insert ends so that the insert ends are captured in the mold walls formed thereabout. The central region of the insert was thereby located in the mold cavity.

A Ti-6A1-4V melt was cast under a vacuum of less than 5 microns into the mold preheated to 600° F. and solidified in the mold cavity about the insert. The composite casting produced was separated from the shell mold and the interfaces FF between the insert and cast-/solidified melt were electron beam welded using a conventional electron beam welder under vacuum of 1 micron (without filler material) to gas tight weld proximate portions of the insert and cast/solidified melt at the interfaces FF. The weld zone was about 0.1 inch in width and penetrated about 0.1 inch in depth into the insert and cast/solidified melt. The sealed composite casting was isostatically pressed at 1650° F. for 3 hours. The pressed casting was metallographically sectioned and found to have a sound. Void-free metallurgical bond produced between the insert and the cast/solidified melt thereabout.

Figure 5:
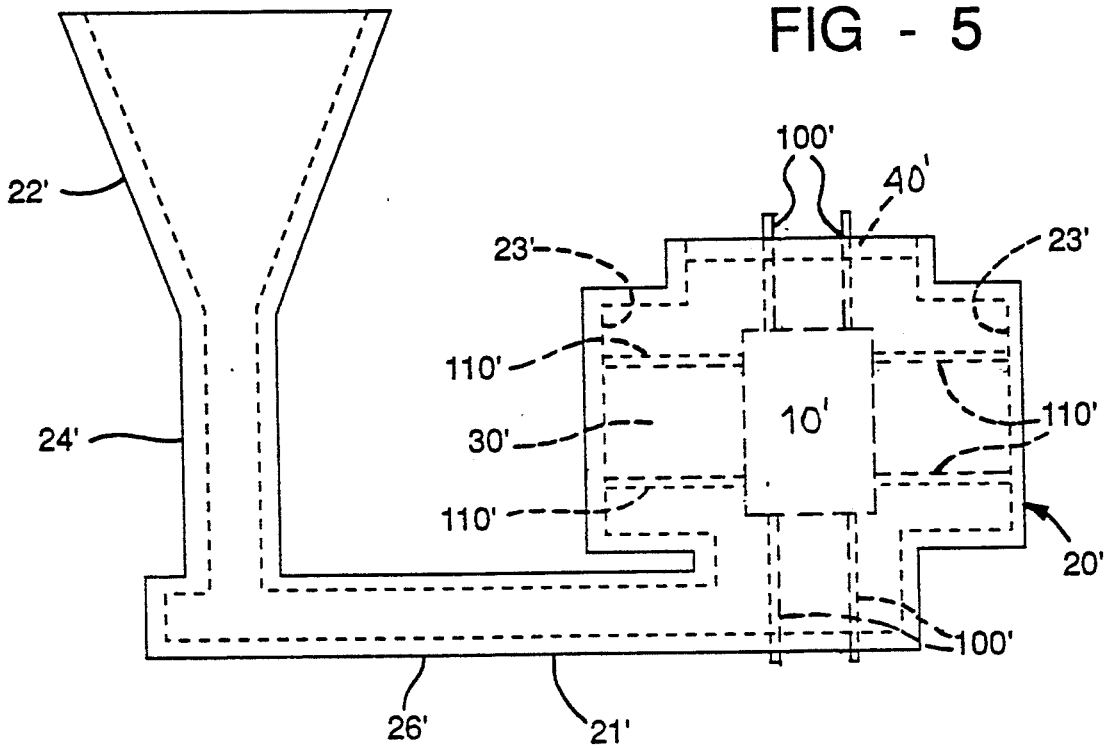
FIG. 5 is a schematic side elevational view of a ceramic shell mold with a performed insert positioned therein by slender pins and chaplets.
Figure 6:
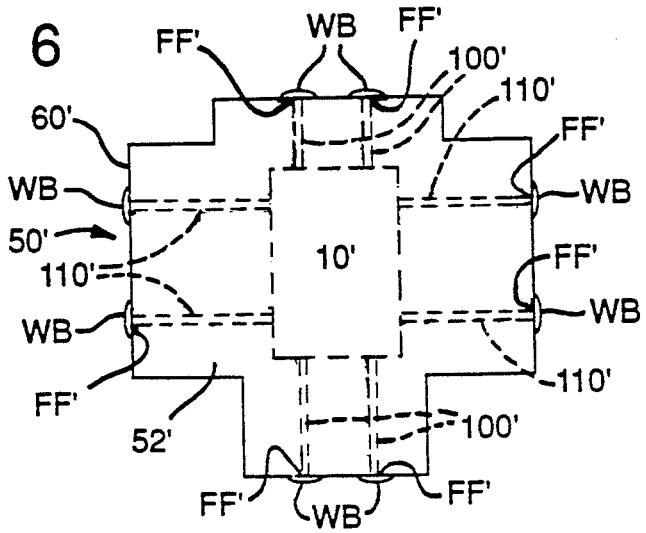
FIG. 6 is a schematic side elevational view of the composite casting formed in the mold of FIG. 5 showing some of the exposed and sealed interfaces between the pins/chaplets and the cast/solidified melt.

Referring to FIGS. 5 and 6, another embodiment of the invention is illustrated wherein like features of FIGS. 1–4 bear like reference numerals primed. This embodiment differs from the embodiment of FIGS. 1–4 in that the preformed insert 10' is positioned in the mold cavity 30' by slender end pins 100' and side chaplets 110' as shown best in FIG. 5. The end pins 100' are welded to the opposite ends of the insert 10' and are fixed in the lower mold wall 21' and in the mold closure cap 40'. The chaplets 110' are welded to the sides of the insert 10' and extend into abutting engagement with the inner, upstanding mold walls 23'. The chaplets 110' are not fixed in the mold walls, however. The pins 100' and chaplets 110' constitute positioning members for precisely locating the insert 10' in the mold cavity 30' . The pins 100' and chaplets 110' preferably comprise a metallic or intermetallic material having the same or similar, or at least compatible, composition as the composition of the cast melt so as not to degrade the properties of the bicasting.

As is apparent from FIG. 5, the outer ends of the pins 100' extend outside the mold while the outer ends of the chaplets 110' extend into abutting engagement with the mold walls 23'. As a result, when a melt is cast and solidified in the mold cavity 30' , a composite casting 50', see FIG. 6, will be produced having interfaces FF' between each pin 100' and chaplet 110' and the cast-/solidified melt 52' proximate thereto. The ends of pins 100' located outside the casting are typically trimmed off flush with the casting exterior surface 60'. The interfaces FF' communicate with the exterior surface 60' of the casting 50'..

Prior to hot isostatically pressing the composite casting 50', the interfaces FF' are sealed in fluid (gas)-tight manner by depositing a weld bead WB over each interface FF', FIG. 6. The weld bead WB can be deposited using an electron beam welding technique and suitable filler material (e.g., Ti for the materials used in the Example set forth hereinabove) to form the weld bead WB.

The gas-tight sealed composite casting 50' can then be hot isostatically pressed in the manner described hereabove to form a sound, void-free metallurgical bond between the insert 10' and the cast/solidified melt 52' thereabout. The weld beads WB are gas tight so as to prevent the pressurizing gas from penetrating and migrating along the interfaces FF'.

The invention provides an improved bicasting type of process for making a composite casting wherein a sound, void-free, contamination-free metallurgical bond is reliably and reproducibly produced between the insert and the cast/solidified melt thereabout.

Moreover, while the invention has been described in terms of specific embodiments thereof, it is not intended to be limited thereto but rather only to the extent set forth in the following claims.

The embodiments of the invention in which an exclusive property or privilege is claimed are defined as follows:

1. A method of making a casting having a preformed reinforcement insert therein, comprising:

a) positioning a preformed metallic or intermetallic reinforcement insert in a melt-receiving cavity of a casting mold, b) solidifying a melt introduced into the melt-receiving cavity about the insert to form a composite casting having an interface between the insert and melt solidified about the insert, said interface communicating with an exterior surface of said casting.

c) separating said mold and said casting, d) fluid-tight sealing said interface at said exterior surface, and e) subjecting the composite casting to elevated temperature and elevated isostatic fluid pressure to form a metallurgical bond between the insert and solidified melt, said sealed interface preventing the fluid pressure from migrating from said exterior surface between said insert and said melt solidified thereabout.

2. The method of claim 1 wherein said interface is sealed by providing fused material at the interface.

3. The method of claim 2 wherein the fused material is provided by welding proximate portions of said insert and said solidified melt at said exterior surface.

4. The method of claim 2 wherein the fused material is provided by depositing a filler material at said interface at said exterior surface.

5. The method of claim 1 wherein a metallic or intermetallic preformed insert is positioned in the mold cavity.

6. The method of claim 5 wherein the preformed insert includes reinforcements therein.

7. A method of making a casting having a preformed reinforcement therein, comprising:

a) positioning a preformed metallic or intermetallic reinforcement insert in a melt-receiving cavity of a casting mold using a slender positioning member between the insert and the mold, b) solidifying a melt introduced into the melt-receiving cavity about the insert to form a composite casting having an interface formed between the positioning member and melt solidified about the insert, said positioning member communicating with the an exterior surface of said casting to form an external interface exposed to ambient atmosphere at said exterior surface, c) separating said mold and said casting, d) fluid-tight sealing said external interface at said exterior surface, and e) subjecting the composite casting to elevated temperature and elevated isostatic fluid pressure to form a metallurgical bond between the insert and solidified melt, said sealed external interface preventing the fluid pressure from migrating between said insert and said melt solidified thereabout.

8. The method of claim 7 wherein said external interface is sealed by providing fused material at the interface at said exterior surface.

9. The method of claim 8 wherein the fused material is provided by welding proximate portions of said insert and said solidified melt at said exterior surface.

10. The method of claim 8 wherein the fused material is provided by depositing a filler material at said exterior surface.

11. The method of claim 7 wherein a metallic or intermetallic preformed insert is positioned in the mold cavity.

12. The method of claim 11 wherein the preformed insert includes reinforcements therein.

* * * * *